US010821740B2

(12) United States Patent
Hauke et al.

(10) Patent No.: US 10,821,740 B2
(45) Date of Patent: Nov. 3, 2020

(54) METHOD AND DEVICE FOR PRINTING A SURFACE WITH A FLUID

(71) Applicant: Merck Patent GmbH, Darmstadt (DE)

(72) Inventors: Guenter Hauke, Meuhltal (DE); Edgar Boehm, Griesheim (DE); Volker Hilarius, Gross-Umstadt (DE)

(73) Assignee: Merck Patent GmbH, Darmstadt (DE)

( * ) Notice: Subject to any disclaimer, the term of this patent is extended or adjusted under 35 U.S.C. 154(b) by 46 days.

(21) Appl. No.: 15/527,936

(22) PCT Filed: Oct. 23, 2015

(86) PCT No.: PCT/EP2015/002113
§ 371 (c)(1),
(2) Date: May 18, 2017

(87) PCT Pub. No.: WO2016/078739
PCT Pub. Date: May 26, 2016

(65) Prior Publication Data

US 2018/0345676 A1 Dec. 6, 2018

(30) Foreign Application Priority Data

Nov. 21, 2014 (DE) ..... 10 2014 017 223

(51) Int. Cl.
*B41J 2/175* (2006.01)
*B41J 2/18* (2006.01)

(52) U.S. Cl.
CPC ..... *B41J 2/17563* (2013.01); *B41J 2/175* (2013.01); *B41J 2/18* (2013.01)

(58) Field of Classification Search
None
See application file for complete search history.

(56) References Cited

U.S. PATENT DOCUMENTS 3,529,626 A * 9/1970 German ..... B05B 9/0403 137/563
5,060,861 A * 10/1991 Holt ..... B05B 9/0423 239/124

(Continued)

FOREIGN PATENT DOCUMENTS

CN 1392056 A 1/2003
CN 1462240 A 12/2003

(Continued)

OTHER PUBLICATIONS

International Search Report for PCT/EP2015/002113 dated Mar. 9, 2016.

(Continued)

*Primary Examiner* — Alejandro Valencia
(74) *Attorney, Agent, or Firm* — Faegre Drinker Biddle & Reath LLP

(57) ABSTRACT

The invention relates to a method for printing a surface (2) with a fluid which contains an organic semiconductor material. The fluid is transported from a storage container (7) through a supply line (5) to a printing head (3), which can be moved over the surface (2), and printed onto the surface (2) by the printing head (3). At least one part of the fluid which is transported through the supply line (5) to the printing head (3) is returned to the storage container (7) via a return line (6), wherein a fluid circuit is formed, and the fluid in the fluid circuit flows through a cleaning device (12) with which the fluid is cleaned. The fluid returned to the storage container (7) flows around and surrounds the fluid being transported in the supply line (5) to the printing head (3) at least in some regions. During the printing process, the storage container (7) is arranged in a fixed location at a distance to the surface (2), and the printing head (3) which is connected to the storage container (7) via a flexible supply (Continued)

line (5) and a flexible return line (6) is moved over the surface (2) for printing purposes.

8 Claims, 2 Drawing Sheets

(56) References Cited

U.S. PATENT DOCUMENTS

| | | | | |
|---|---|---|---|---|
| 7,097,287 | B2 | 8/2006 | Nakao et al. | |
| 8,246,131 | B2 | 8/2012 | Cheng et al. | |
| 8,511,809 | B2 * | 8/2013 | Yunoki | B41J 2/175 347/94 |
| 8,974,046 | B2 * | 3/2015 | Ooishi | B41J 2/175 347/7 |
| 9,356,242 | B2 | 5/2016 | Kaiser et al. | |
| 2003/0007047 | A1 | 1/2003 | Otsuka et al. | |
| 2003/0151637 | A1 | 8/2003 | Nakamura et al. | |
| 2008/0297546 | A1 | 12/2008 | Lee et al. | |
| 2012/0314009 | A1 | 12/2012 | Kasahara | |

FOREIGN PATENT DOCUMENTS

| | | | |
|---|---|---|---|
| CN | 101314285 | A | 12/2008 |
| CN | 102049900 | A | 5/2011 |
| EP | 0076914 | A2 | 4/1983 |
| JP | 201069669 | A | 4/2010 |
| JP | 2010264689 | A | 11/2010 |
| JP | 201291420 | A | 5/2012 |
| JP | 2013252506 | A | 12/2013 |
| WO | WO-2013050101 | A1 | 4/2013 |

OTHER PUBLICATIONS

Written Opinion of the International Searching Authority for PCT/EP2015/002113 dated Mar. 9, 2016.

* cited by examiner

METHOD AND DEVICE FOR PRINTING A SURFACE WITH A FLUID

CROSS-REFERENCE TO RELATED APPLICATIONS

This application is a national stage application (under 35 U.S.C. § 371) of PCT/EP2015/002113, filed Oct. 23, 2015, which claims benefit of German Application No. 102014017223.6, filed Nov. 21, 2014, both of which are incorporated herein by reference in their entirety.

The invention relates to a method for printing a surface with a fluid which contains an organic semiconductor material, wherein the fluid is conveyed from a storage container through a supply line to a printing head that is displaceable across the surface and said fluid is printed on the surface by the printing head.

BACKGROUND OF THE INVENTION

Numerous fields of application and potential uses for organic semiconductor materials have been developed in various sectors of application in recent years. In organic electronics or in molecular electronics, organic semiconductor materials are combined with electronic construction elements in order to be able to utilize the advantageous properties of the organic semiconductor material in the electronic construction elements. Using suitable organic semiconductor materials, organic light emitting diodes (OLEDs) and large-area displays can, for example, be produced from organic light emitting diode assemblies.

Organic semiconductor materials also have advantageous properties and potential uses in the processing potentials and in the production of electronic construction elements. It is thus known in practice that organic semiconductor materials can be dissolved in a fluid and can be processed by way of printing technology, wherein the organic semiconductor material that has been dissolved in a fluid can be applied in a non-contacting manner onto a large-area surface to be printed in particular by using suitably modified inkjet systems.

In order to be able to produce homogeneous layers from the organic semiconductor material in as flawless a manner as possible, it is necessary for the organic semiconductor material to have a very high degree of purity and to contain as few objectionable foreign particles or air inclusions as possible. Moreover, it has been demonstrated that most of the organic semiconductor materials which have properties that are advantageous for the production of goods and are used therefor have an extremely sensitive reaction to any contact with oxygen and air. In order to avoid or minimize, respectively, as far as possible any contamination of the organic semiconductor material, the organic semiconductor material is often filled into storage containers under high-purity environmental conditions, taken to the site of consumption in the storage containers that are then closed in a gas-tight manner, and at said site of consumption processed so as to be shielded as far as possible from contaminating particles or gases and in particular oxygen.

When changing over between different storage containers which in each case are sequentially connected to the printing systems in use and then emptied, it is often necessary for the supply line from the storage container up to the exit opening of the printing system to be flushed such that an amount of fluid that is required for the flushing procedure can no longer be used for printing. When changing over between different fluids, a complex cleaning of the printing system is moreover typically required such that additional losses in terms of fluid are unavoidable.

Contamination of the fluid by pollutants such as by particles that are released from a storage container wall, by particles that ingress by way of filling or discharging openings and by way of diffusion of gases, in particular oxygen, is facilitated by vast transportation distances between the site of the production of the fluid and filling of a storage container and the site of consumption of the fluid for printing a surface using a printing system, and by a long storage time up to the depletion of the amount of fluid that is located in a storage container. For this reason, storage containers with a small usable volume are often used, and during a printing procedure are disposed as close as possible in spatial terms to an exit nozzle of the printing system and depleted as rapidly as possible. Despite a significant complexity, an undesirable contamination of the fluid is unavoidable in most instances.

BRIEF SUMMARY OF THE INVENTION

It is seen as an object of the present invention to design a method for printing a surface with a fluid that contains an organic semiconductor material such that a maximum possible purity of the fluid that is used for printing the surface is achieved at minimum possible fluid losses.

This object is achieved according to the invention in that at least part of the fluid which is conveyed through the supply line to the printing head is conveyed back into the storage container by way of a return line, wherein a fluid circuit is formed, and in that the fluid in the fluid circuit perfuses a purification installation by way of which the fluid is purified. By way of the formation of the fluid circuit which comprises a purification installation, it is enabled that the fluid that is located in the storage container can flow through the purification installation and thereby be cleaned, optionally multiple times.

DETAILED DESCRIPTION OF THE INVENTION

This purification of the fluid can be carried out directly prior to the use of the fluid, or prior to the commencement of a printing procedure, respectively. It is no longer necessary for the fluid to be purified with great complexity prior to being filled into the storage container and to additionally ensure that any renewed contamination of the fluid is avoided or is minimized as far as possible, respectively, during transportation of the storage container from the production site to the site of intended consumption. Requirements in terms of the purity of the participating components and the shielding of the fluid prior to and during the printing procedure that are less stringent than before can be set for the printing device by which the printing procedure is carried out, since the fluid that is provided for the printing procedure can be conveyed through the device and thereby purified on demand and optionally multiple times or else continuously.

Purification of an amount of fluid that is being recirculated in the fluid circuit can moreover also be performed continuously or at temporal intervals while a printing procedure is being carried out, so as to reduce any contamination of the fluid. Therefore, it is not necessary for the amount of fluid that is located in the storage container to be depleted as fast as possible.

According to one particularly advantageous design embodiment of the concept of the invention, it is provided that the fluid that is conveyed back to the storage container herein at least in portions flows around the fluid that in the supply line is conveyed to the printing head. Many organic semiconductor materials which are suitable for the production of large-area displays, for example, can be undesirably contaminated in a rapid manner by oxygen which is absorbed from the environment or ingresses to the fluid, respectively. For this purpose, many components of the printing device are designed such and produced from suitable materials such as stainless steel, for example, that any ingress of oxygen to the fluid, or a diffusion procedure of said oxygen in the fluid, respectively, is avoided and minimized as far as possible. The undesirable ingress of oxygen to the fluid which is conveyed through the supply line to the printing head can be impeded and optionally largely prevented in that the fluid that is conveyed back to the storage container at least in portions completely surrounds the supply line such that oxygen from the environment that ingresses to the fluid lines can ingress substantially only to the return line and thus to the fluid that is being conveyed back again to the storage container. The return line which surrounds the supply line forms an additional shield and the functional barrier for the supply line that is surrounding by the return line. The fluid that is conveyed back again through the return line, prior to being resupplied to the printing head, can be purified in a pre-emptive manner or upon demand, so as to reduce any potential contamination.

It is furthermore provided that during a printing procedure the storage container is disposed in a locationally fixed manner so as to be spaced apart from the surface, and for printing the printing head that by way of a flexible supply line and a flexible return line is connected to the storage container is displaced across the surface. A large spacing between the storage container and the printing head is enabled by the potential for the fluid to be recirculated in a fluid circuit and herein to be purified by way of the purification installation that is incorporated in the fluid circuit, since any potential contamination within the printing device or in the fluid circuit, respectively, during the printing procedure can be reduced with the aid of the purification installation. It is not necessary for the storage container to be disposed directly at or on the printing head and to be displaced conjointly with the printing head across the surface during the printing procedure. The storage container can be disposed in a locationally fixed manner so as to be spaced apart from the surface to be printed. The connection of the storage container to the printing head is enabled by way of a flexible supply line and a flexible return line. The flexible supply line is additionally shielded by the return line that surrounds the supply line. Any contamination of the fluid that is optionally facilitated by a longer dwell time in the supply line can be reduced on demand again in that the fluid is conveyed through the return line and through the purification installation.

A cost-effective production of efficient and rapid printing devices is enabled by the arrangement of the storage container so as to be spaced apart from the surface and in particular so as to be spaced apart from the printing head, and the incorporation of the latter by means of a flexible supply line and a flexible return line. The storage containers which are disposed in a spaced apart and locationally fixed manner can have a significantly larger capacity than storage containers which are disposed on or at a displaceable printing head. An individual printing procedure can be carried out and completed in a significantly more rapid manner. A large number of printing procedures can be carried out with each of the large-capacity storage containers before a replacement of the storage container is required.

In order for a purification of the fluid that is as efficient and effective as possible to be achieved, it is provided that the fluid in the purification installation is conveyed through a degassing installation and through a particle filtration installation. Any undesirable contamination by gas and in particular any contamination by oxygen that is detrimental to the organic semiconductor materials can be reduced by way of the degassing installation. Particles which are released from the storage container, for example during transportation or during prolonged storage, or from components of the printing device and contaminate the fluid can be filtered from the fluid by way of the particle filtration installation. The particle filtration installation for its part can be configured so as to have multiple stages or so as to have a plurality of different filter components, so as to be able to catch increasingly finer particles and to be able to filter the latter from the fluid flow. It is likewise conceivable that the fluid, in the case of less stringent requirements set for the purity of the fluid that is applied by the printing head, for example, or for cost reasons, prior to being supplied to the printing head and by way of the printing head being printed onto the surface to be printed, is conveyed through only a degassing installation or through only a particle filtration installation.

In order to be able to guarantee that only fluid of sufficient purity is used during a printing procedure and printed on the surface to be printed by the printing head, it is provided according to the invention that the fluid in the fluid circuit is conveyed through an analysis installation and an analysis of the fluid is carried out. Suitable key indicators for the fluid and the purity of the fluid that is being conveyed through the analysis installation, for example, can be determined by the analysis installation. The analysis installation in the flow direction is expediently disposed behind the purification installation such that the analyses carried out herein by the analysis installation describe the fluid after purification and directly prior to being supplied to the printing head.

The analysis installation can be connected to a data storage installation, so as to detect and store the results of the analyses carried out herein prior to the commencement of a printing procedure or continuously during a printing procedure, for example. In this way, a retrospective evaluation of the analyses carried out prior to or during the printing procedure can also be carried out.

It is advantageously provided that a use of the printing head for printing the surface is released or blocked so as to depend on a result of the analysis. For example, should the result of the analysis demonstrate that the fluid is of insufficient purity in order for positive printing results to be guaranteed, the printing head can be blocked for printing and the fluid can be conveyed through the fluid circuit so as to effect purification of the fluid in the purification installation. The analyses herein can be continued and the purification of the fluid that has already been effected by the purification installation can be checked prior to the printing head being released again for printing the surface.

The invention also relates to a device for printing a surface with a fluid which contains an organic semiconductor material, wherein the device has a storage container for the fluid, a printing head that for printing the surface with the fluid is displaceable across the surface to be printed, and a supply line by way of which the fluid can be conveyed from the storage container to the printing head.

It is provided according to the invention that the device has a return line by way of which at least a proportion of the fluid that is conveyed to the printing head can be conveyed back into the storage container, wherein a fluid circuit can be formed conjointly by the return line and the supply line, and that the device has a purification installation for the fluid, said purification installation being disposed in the fluid circuit and being able to be perfused by the fluid.

According to one advantageous design embodiment of the concept of the invention, it is provided that the return line in the circumferential direction completely surrounds at least a portion of the supply line. The return line can at least in portions be designed so as to be hollow cylindrical and surround the supply line that is disposed in a concentric manner in an interior space of the hollow cylinder. It is likewise conceivable for the return line to run around the supply line in a helical manner. On account thereof, the return line forms a shield for the supply line in relation to the environment and to any contamination of the fluid in the supply line. The return line can completely surround and shield the supply line across substantially the entire length of the supply line. It is likewise conceivable for the return line to surround the supply line only along a portion or in particularly exposed regions.

In order for a cost-effective application of the displaceable printing head to be enabled on a storage container that is disposed so as to be spaced apart from the printing head, it is provided according to the invention that the supply line and the return line are flexible at least in portions and are disposed between the storage container that is disposed in a locationally fixed manner and the displaceable printing head. The storage container can be separated and shielded from the displaceable printing head and the surface to be printed by a housing wall or a room wall, for example, such that a replacement of the storage container is possible without compromising the environmental conditions in the direct environment of the surface to be printed. The volume of the storage container that is disposed so as to be spaced apart from the printing head can be a few liters or more. The storage container that is disposed in a locationally fixed manner can be provided with suitable rapid-coupling connectors and be rapidly replaced. It is likewise conceivable for a plurality of storage containers which are capable of being put into operation in a sequential manner to be provided. Once a first storage container has been completely emptied, switching over can take place and a second storage container can be used, allowing a printing procedure to be continued as quickly as possible. The first storage container can be re-filled or be replaced by a re-filled storage container. In this way, a large number of printing procedures can be carried out in an almost uninterrupted manner.

The purification installation expediently has a degassing installation and a particle filtration installation. The degassing installation and the particle filtration installation that optionally can be configured in multiple stages or comprise various components can be disposed outside the storage container. It is likewise conceivable for the degassing installation and the particle filtration installation to be integrated in the storage container and to be able to be replaced conjointly with the storage container and to be re-generated for example when the storage container is refilled.

In individual cases it can be advantageous for cost reasons, for example, for the purification installation to have only a degassing installation or only a particle filtration installation as long as degassing or filtration of the fluid is considered to be unnecessary or disproportionately cost-intensive. It is likewise possible for the degassing installation and the particle filtration installation not to be a permanent component part of the purification installation and to be integrated in the circuit or in the storage container for the fluid only on demand.

The device can furthermore have an analysis installation for analyzing the fluid. The printing head, by way of a controller installation which is connected in a signal-transmitting manner to a printing-head releasing installation, can be released or else blocked for a forthcoming printing procedure should the requirements necessary for a printing procedure not be met. Analysis results can be transmitted to the controller installation by way of a connection between the analysis installation and the controller installation, and the printing head can be released or else blocked, depending on the analysis results.

Both the analysis installation as well as the controller installation can be disposed in the storage container or be integrated in the latter, respectively. In this case, the storage container in order to be able to be connected to the printing head only has to have connectors for connection to the supply line and to the return line. As soon as the storage container is connected to the supply line and to the return line, the fluid that is located in the storage container can be conveyed through the fluid circuit and be analyzed. Should the analyses indicate that the fluid does not have the required purity, releasing of the printing head can be denied in order for additional purification of the fluid to be carried out first. As soon as the required purity has been verified by the analysis installation, the printing head can be released and a pending printing procedure can be commenced.

In this way, purification and controlling of a printing procedure can be carried out in an autonomous manner with the aid of a suitably designed storage container. Complex adapting of the printing device that is installed on site is not required.

The provision of the fluid having an organic semiconductor material in organizational and spatial terms is usually performed separately from the operation of the printing device and from the intended use of the fluid having the organic semiconductor material for printing surfaces. Key indicators for the purity of the fluid can be documented during the use of the latter and the retrieval of the latter from the storage container with the aid of data storage of analysis results which are continuously acquired and detected during operation of the printing device and progressive emptying of the storage container. In this way, causes of and the responsibility for potential errors that arise during the operation can be more easily established and assigned.

In the case of an integrated arrangement of the purification installation in the storage container it is likewise possible for a recirculation and purification of the fluid that is located in the latter to be carried out in the interior of the storage container, without the storage container being connected to a printing installation or to a supply line and to a return line. In this case, purification of the fluid that is located in the filled storage container is also possible, for example, during warehousing of the filled storage container prior to the latter being used, so as to reduce at temporal intervals any intervening contamination of the fluid that could have potentially occurred.

Various design embodiments of the concept of the invention which are illustrated in the drawing will be explained in more detail hereunder. In the drawing.

Figure 1:
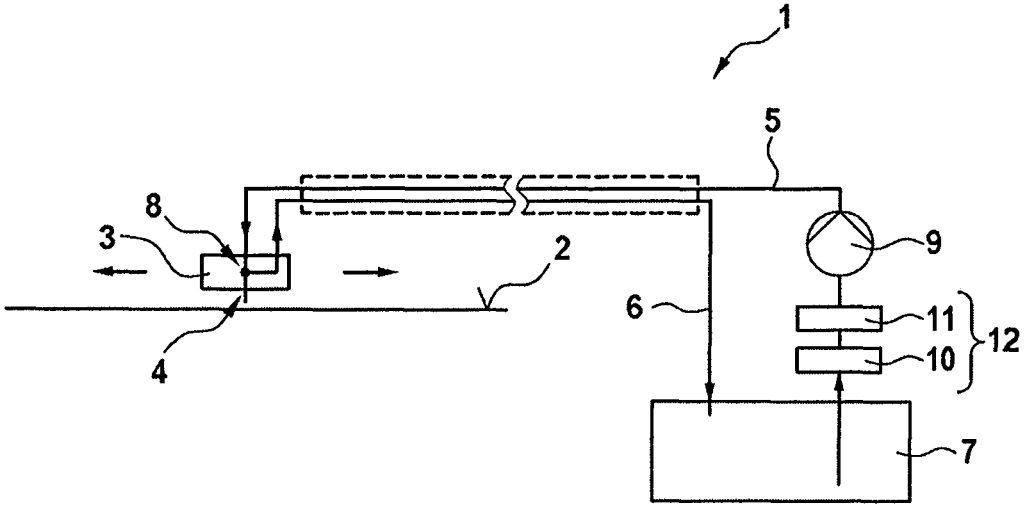
FIG. 1 shows a schematic illustration of a device for printing a surface, in which a storage container is disposed so as to be spaced apart from a printing head that is displaceable across a surface and is connected by way of a flexible supply line and a flexible return line to the displaceable printing head.

A device 1, schematically illustrated in FIG. 1, for printing a surface 2 has a printing head 3 that is displaceable across the surface 2. A fluid from a printing nozzle 4 of the printing head 3 can be sprayed onto the surface 2 and thus be printed onto the surface 2.

The printing head 3 by way of a flexible supply line 5 and a return line 6 that is likewise designed so as to be flexible is connected to a storage container 7 that is disposed so as to be spaced apart from the surface 2. The storage container 7 is disposed in a locationally fixed manner. The supply line 5 that is designed so as to be flexible, and the return line 6 that is likewise designed so as to be flexible, enable an incorporation of the displaceable printing head 3 on the storage container 7 that is disposed in a locationally fixed manner.

A control valve 8 by way of which the fluid that by way of the supply line 5 is supplied to the printing head 3 can either be sprayed through the printing nozzle 4 onto the surface 2, or else be guided into the return line 6 so as to be conveyed back into the storage container 7, is disposed in the printing head 3. The supply line 5 and the return line 6 form a fluid circuit.

A pump 9 by way of which the fluid can be conveyed from the storage container 7 toward the printing head 3 is disposed in the supply line 5. When the control valve 8 blocks the printing nozzle 4 and guides the fluid that by way of the supply line 5 is conveyed into the printing head 3 into the return line 6, the pump 9 generates a circulation of fluid in the fluid circuit.

Furthermore disposed in the supply line 5 are a degassing installation 10 and a particle filtration installation 11 by way of which the fluid that is conveyed through the supply line 5 is purified. Herein, particles are filtered out and any undesirable contamination of the fluid by gas is reduced.

Figure 2:
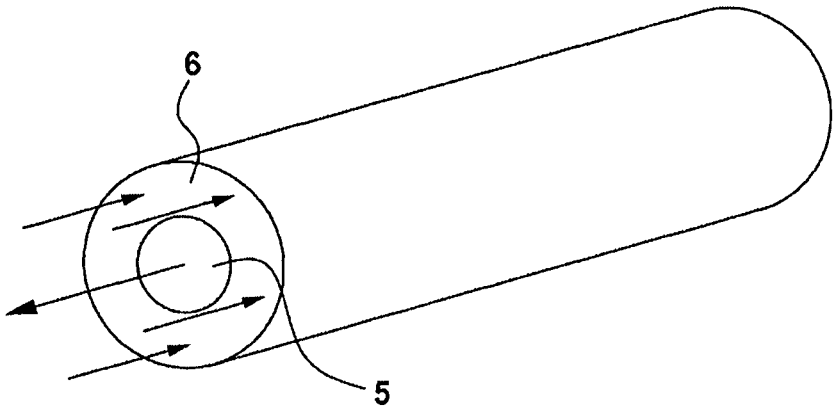
FIG. 2 shows a schematic illustration of a design embodiment of the flexible supply line and of the flexible return line that surrounds the supply line.

An advantageous design of the supply line 5 and of the return line 6 is schematically illustrated in FIG. 2. The return line 6 herein is designed so as to be hollow cylindrical and surrounds the supply line 5 that is disposed in a concentric manner in an interior space of the hollow cylinder. Exemplary flow directions of the fluid in the supply line 5 and in the return line 6 are indicated by the arrows. The return line 6, within a wide region which in FIG. 1 is indicated by dashed lines, herein in the circumferential direction completely surrounds the supply line 5 and forms a shield of the supply line 5 in relation to the environment. On account thereof, any contamination of the fluid that is located in the supply line 5 or in the return line 6 that is almost inevitable when flexible line materials are used is largely concentrated in and limited to the fluid that is located in the return line 6, said fluid being conveyed back into the storage container 7 and, prior to being conveyed to the printing head 3 again, being purified by the degassing installation 10 and the particle filtration installation 11. The degassing installation 10 and the particle filtration installation 11 can in each case be configured in multiple stages or in each case have a plurality of components. The degassing installation 10 and the particle filtration installation 11 form a purification installation 12 for the perfusing fluid.

Figure 3:
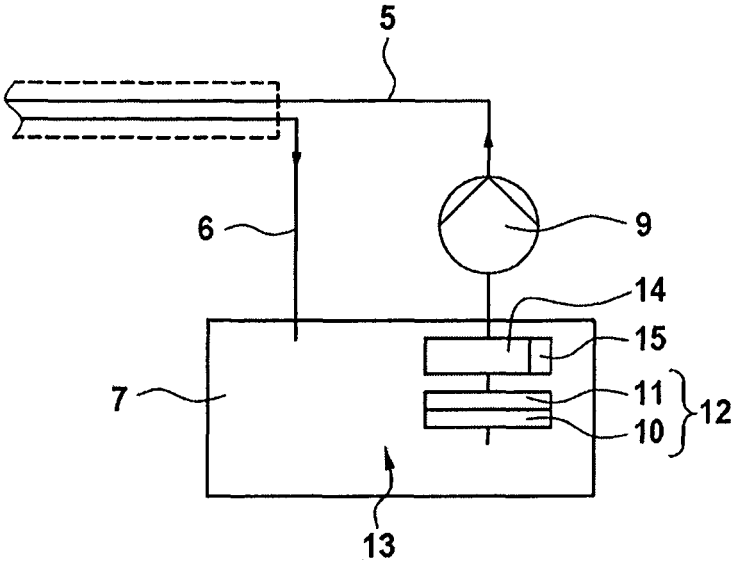
FIG. 3 shows a schematic illustration of a storage container in which a purification installation and an analysis installation are integrated.

A configuration of the storage container 7 and of the purification installation 12 that is of a deviating design is illustrated in a merely exemplary manner in FIG. 3. The degassing installation 10 and the particle filtration installation 11 of the purification installation 12 are disposed in an interior space 13 of the storage container 7. Furthermore disposed in the interior space 13 of the storage container 7 is an analysis installation 14 having a controller installation 15. The fluid that is conveyed by the pump 9 into the supply line 5 and toward the printing head 3 is initially conveyed from the interior space 13 of the storage container 7 through the purification installation 12 and subsequently through the analysis installation 14, before said fluid can make its way into the supply line 5 and to the printing head 3. Subsequent to the purification of the fluid, an analysis is carried out by the analysis installation 14. The result of the analysis with the aid of the controller installation 15 can be transmitted to the control valve 8 of the printing head 3, in order for the printing head 3 to be released for a printing procedure, or else to be blocked, so as to direct the fluid that is conveyed through the supply line 5 toward the printing head 3 into the return line 6 and to supply said fluid again to the storage container 7 for a repeat purification.

Figure 4:
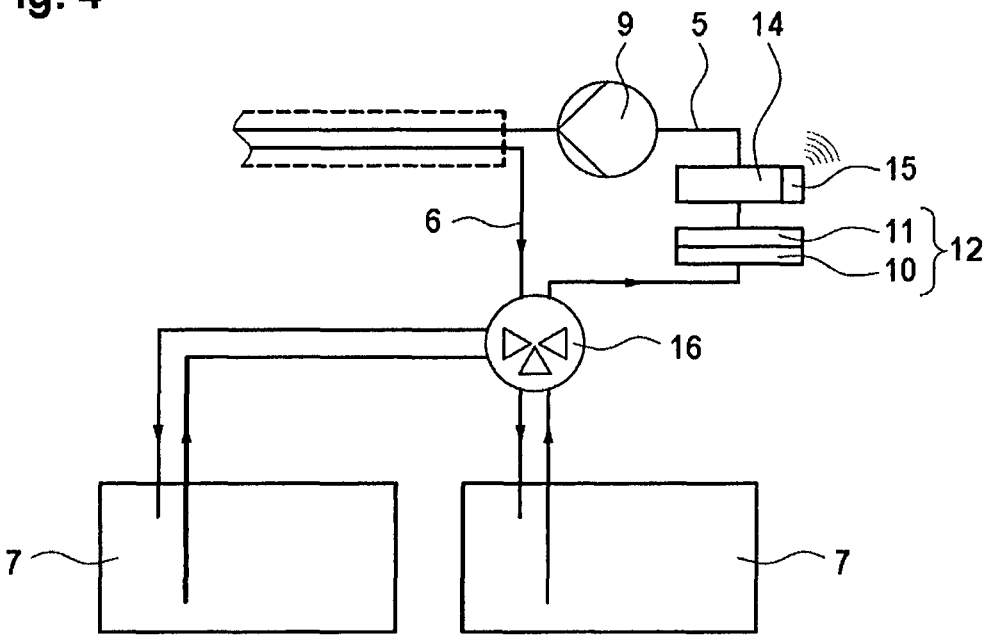
FIG. 4 shows a schematic illustration of a part-region of the printing device, in which two storage containers by way of a three-way valve can be selectively connected to the supply line and to the return line.

A part-region of a variant of the device 1 of a deviating design is illustrated schematically in FIG. 4. The supply line 5 and the return line 6 by way of a three-way valve 16 are selectively connected to one of two storage containers 7. While one of the two storage containers 7 is connected to the printing head 3 for carrying out printing procedures, the other storage container 7 can be exchanged and replaced by a storage container 7 that is filled with fresh fluid. As soon as the fluid from the currently used storage container 7 is almost depleted, switching can take place by way of the three-way valve 16, and the other storage container 7 that is filled with the fresh fluid can be continued to be used. In this way, downtime periods during operation of the device 1 can be significantly reduced.

The purification installation 12 and the analysis installation 14 in the case of this exemplary embodiment are disposed externally and not integrated in the storage containers 7. The controller installation 15 that is connected to the analysis installation 14 can transmit items of control information to the control valve 8 in the printing head 3 in a wireless manner.

It is likewise possible that the pump 9, in a manner independent of any variant of the device 1 described in the exemplary embodiments, can be disposed at any arbitrary location within the fluid circuit. The pump 9 in the flow direction can thus also be disposed ahead of the purification installation 12 or optionally between the purification installation 12 and the analysis installation 14. It is likewise possible for the purification installation 12 and optionally also the analysis installation 14 to be disposed in the return line 6.

The invention claimed is:

1. A method for printing on a surface with a fluid which contains an organic semiconductor material, wherein the fluid is conveyed from a storage container through a supply line to a printing head that is displaceable across the surface and said fluid is printed on the surface by the printing head, wherein at least part of the fluid which is conveyed through the supply line to the printing head is conveyed back into the storage container by way of a return line, wherein a fluid circuit is formed, and in that the fluid in the fluid circuit perfuses a purification installation, wherein the fluid in the purification installation is conveyed through a degassing installation and a particle filtration installation by way of which the fluid is purified, wherein the degassing installation and the particle filtration installation are integrated in the storage container, wherein the fluid that is conveyed back to the storage container herein at least in portions flows around the fluid that in the supply line is conveyed to the printing head.

2. The method as claimed in claim 1, wherein during a printing procedure the storage container is disposed in a locationally fixed manner so as to be spaced apart from the surface, and for printing the printing head that by way of a flexible supply line and a flexible return line is connected to the storage container is displaced across the surface.

3. The method as claimed in claim 1, wherein the fluid in the fluid circuit is conveyed through an analysis installation and an analysis is carried out.

4. The method as claimed in claim 3, wherein a use of the printing head for printing the surface is released or blocked so as to depend on a result of the analysis.

5. A device for printing a surface with a fluid which contains an organic semiconductor material, wherein the device has a storage container for the fluid, a printing head that for printing the surface with the fluid is displaceable across the surface to be printed, and a supply line by way of which the fluid can be conveyed from the storage container to the printing head, wherein the device has a return line by way of which at least a proportion of the fluid that is conveyed to the printing head can be conveyed back into the storage container, wherein a fluid circuit can be formed conjointly by the return line having a circumferential direction and the supply line, and in that the device has a purification installation for the fluid, said purification installation has a degassing installation and a particle filtration installation, and the degassing installation and the particle filtration installation are integrated in the storage container and and being able to be perfused by the fluid, wherein the return line in the circumferential direction completely surrounds at least a portion of the supply line.

6. The device as claimed in claim 5, wherein the supply line and the return line are flexible at least in portions and are disposed between the storage container that is disposed in a locationally fixed manner and the displaceable printing head.

7. The device as claimed in claim 5, wherein the device has an analysis installation for analyzing the fluid.

8. The device as claimed in claim 5, wherein the device has a controller installation having a printing-head releasing installation.

* * * * *